US008028685B2

(12) United States Patent
Clark

(10) Patent No.: US 8,028,685 B2
(45) Date of Patent: Oct. 4, 2011

(54) ADJUSTABLE CABLE GUIDE FOR ARCHERY BOW

(76) Inventor: Roland Clark, Huntington Beach, CA (US)

( * ) Notice: Subject to any disclaimer, the term of this patent is extended or adjusted under 35 U.S.C. 154(b) by 0 days.

(21) Appl. No.: 12/658,409

(22) Filed: Feb. 9, 2010

(65) Prior Publication Data

US 2011/0192385 A1 Aug. 11, 2011

(51) Int. Cl.
*F41B 5/10* (2006.01)

(52) U.S. Cl. ..... 124/25.6

(58) Field of Classification Search ..... 124/25.6, 124/86

See application file for complete search history.

(56) References Cited

U.S. PATENT DOCUMENTS

| | | | | |
|---|---|---|---|---|
| 4,207,858 | A * | 6/1980 | Blackstone | 124/25.6 |
| 5,722,385 | A * | 3/1998 | Bunk | 124/86 |
| 5,983,880 | A * | 11/1999 | Saunders | 124/25.6 |
| 6,722,354 | B1 * | 4/2004 | Land | 124/25.6 |
| 6,904,900 | B2 * | 6/2005 | Gallops, Jr. | 124/25.6 |

* cited by examiner

*Primary Examiner* — John Ricci
(74) *Attorney, Agent, or Firm* — Roy A. Ekstrand

(57) ABSTRACT

An adjustable cable guide for archery bow provides a housing which supports a pair of rotatable pulleys upon which the cam cables of the bow are received. A slide mounting of each pulley supporting segment is adjustable by a threaded adjustment screw. The entire adjustable cable guide assembly is supportable upon the riser directly or may be supported upon the conventional cable guide bar which extends from the riser.

18 Claims, 7 Drawing Sheets

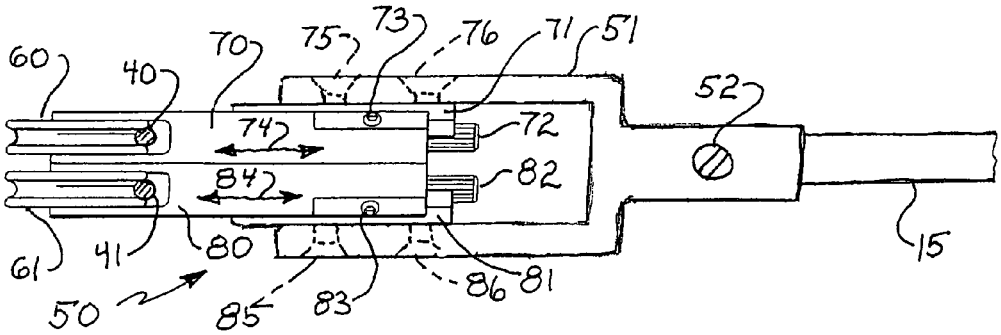
FIG 7
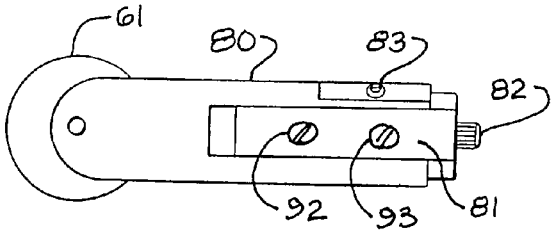
FIG 9
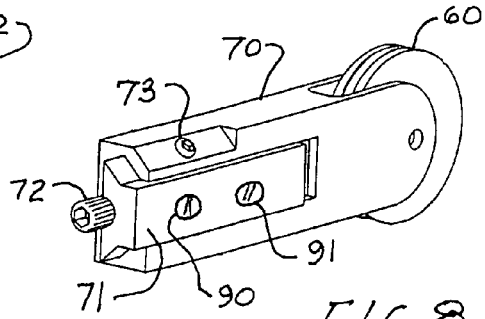
FIG 8
FIG 14
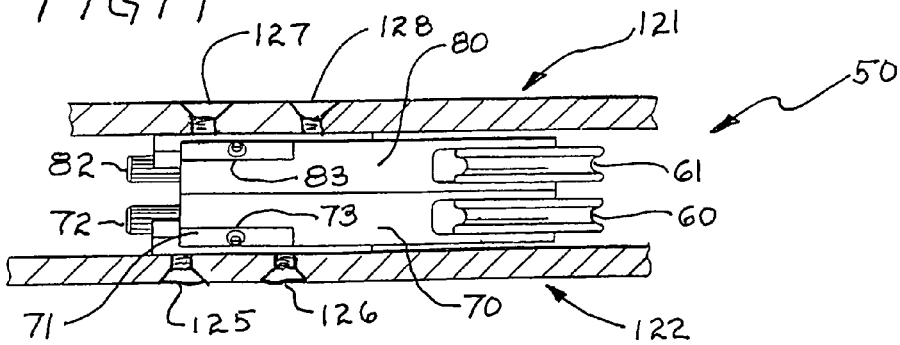

ADJUSTABLE CABLE GUIDE FOR ARCHERY BOW

FIELD OF THE INVENTION

This invention relates generally to archery and bows and particularly to apparatus for setting up and timing the cam action and synchronization of an archery bow.

BACKGROUND OF THE INVENTION

Modern archery is the result of extended development through many years as practitioners endeavored to produce the capability for launching arrows with greater and greater energy power range and accuracy. From earliest bows which, were in essence, simple resilient wooden members drawn into a curved position by a bowstring, archery bows have developed through the application of scientific endeavor into extremely high technology apparatus useful in sporting and hunting activities. While archery bows originally formed of resilient wood or other resilient material operated in a straight forward easily understood manner in which the resilience of the bow stored energy as the bowstring was drawn, modern archery bows operate in a much more complex and sophisticated manner. The result of this complex and sophisticated fabrication greatly increases the power and accuracy of the modern bow.

In its typical fabrication, the modern bow provides a rigid riser which supports a pair of limb sockets at its upper and lower ends together with a handle grip near the center. The riser typically supports an arrow rest structure which may be either static or movable as preferred. A pair of flexible resilient limbs are supported by each limb socket and extend rearwardly to define movable end portions. The movable ends of the flexible limbs support one or more rotatable cams. Each cam defines a profile which translates its rotational motion to the desired distance from the center of rotation to produce the camming action. In most modern archery bows, a pair of cables are strung over and between the cams to provide the "bowstring" for knocking the arrow. Because the cables typically pass between the cams several times, a cable guide apparatus is often provided which offsets the additional cable portions from the cable path of the main bowstring portion.

As the bowstring is drawn, the cables are drawn over the cams rotating the cams and flexing the limbs inwardly to store energy as the limbs are bent. The action of the cams influences the draw characteristics of the bow and the energy storage in the flexing limbs. With the arrow held against the bowstring portion of the cables and the bow drawn, the release of the cable allows the limbs to spring outwardly toward their original positions rapidly rotating the cams and drawing the cable back toward its original static position. The rapid movement of the bowstring portion of the cable transfers the energy of the stored limbs into the arrow and launches the arrow. The profiles of the cams are designed and selected to produce the force and acceleration characteristics of the bow to maximize the energy transferred to the arrow for a given draw strength.

The optimum performance of a modern archery bow requires that the cams be precisely positioned relative to each other throughout the rotational range of operation. In particular, the optimum performance of the archery bow requires that the cams be rotationally synchronized in their draw positions. The precision of rotational positions of the cams is required to ensure that the cams rotate together in synchronism when the bowstring is released. The object of cam positioning is to ensure that the bowstring when released moves forwardly without being drawn upwardly or downwardly. If the cams of the bow are not properly synchronized in their operation, the portion of the bowstring to which the arrow is knoched is moved vertically as well as forwardly. This vertical motion raises or lowers the end of the arrow as it is driven forward during launch. Vertical motion of the arrow in turn changes the angle of the arrow as it is driven forward leading to inaccurate launch and flight.

The critical need for proper synchronization of cam position and action in the modern archery bow leads to a process of fabrication and preparation typically referred to in the art as "timing". Practitioners typically place the bow in a specialized fixture which supports the bow and applies force to the limbs flexing them inwardly to a position corresponding to the full draw of the bow. With the limbs flexed by the adjustment fixture, the practitioner then adjust the length of each cable to obtain identical rotational positions for each cam. In many instances, this cable length adjustment is carried forward by twisting either or both of the cables. While this method of cam timing can be accurate and effective while practiced by a skilled practitioner, the use of fixture timing requires a specialized fixture apparatus and is subject to substantial investment of time and labor. For the most part, this process may be described as a trial and error process as the practitioners repeatedly adjust cable lengths to obtain the timed position of the cams.

There arises therefore a need in the art for a simpler less time consuming and burdensome apparatus and method for timing the modern archery bow.

SUMMARY OF THE INVENTION

Accordingly, it is a general object of the present invention to provide an improved apparatus for timing a modern archery bow. It is a more particular object of the present invention to provide an effective apparatus and method for timing and modern bow which avoids the need for specialized fixture and trial and error operation.

In accordance with the present invention, there is provided an adjustable cable guide for use in combination with an archery bow, the adjustable cable guide comprising: at least one engagement for engaging at least one bow cable; at least one adjuster supporting the at least one engagement in an adjustable position; and support means for supporting the at least one adjuster upon a bow such that the at least one engagement engagers at least one bow cable.

In another aspect of the present invention, for use in combination with an archery bow having a riser, limbs and plurality of pulleys thereon together with a plurality of cables therebetween, an independently adjustable cable guide comprising: a first guide segment supporting a first rotatable pulley, a first slide moveable upon the first guide and a first adjustable coupler coupled between the first guide segment and the first slide to adjust the position therebetween; a second guide segment supporting a second rotatable pulley, a second slide moveable upon the second guide and a second adjustable coupler coupled between the second guide segment and the second slide to adjust the position therebetween; and a guide supporting on the bow riser for supporting the first and second guide segments such that the first and second pulleys each engage a bow cables, the adjustment of the first and second adjustable couplers providing independent position adjustments of the first and second pulleys against respective bow cables.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 7 sets forth a top view of the present invention adjustable cable guide utilized in FIG. 1;

FIG. 8 sets forth a perspective view of a single segment cable guide constructed in accordance with the present invention;

FIG. 9 sets forth a side elevation view of the cable guide segment shown in FIG. 8;

FIG. 14 sets forth a partial section view of the present invention adjustable cable guide shown in FIG. 13 taken along section lines 14-14 therein.

DESCRIPTION OF THE PREFERRED EMBODIMENTS OF THE INVENTION

Figure 1:
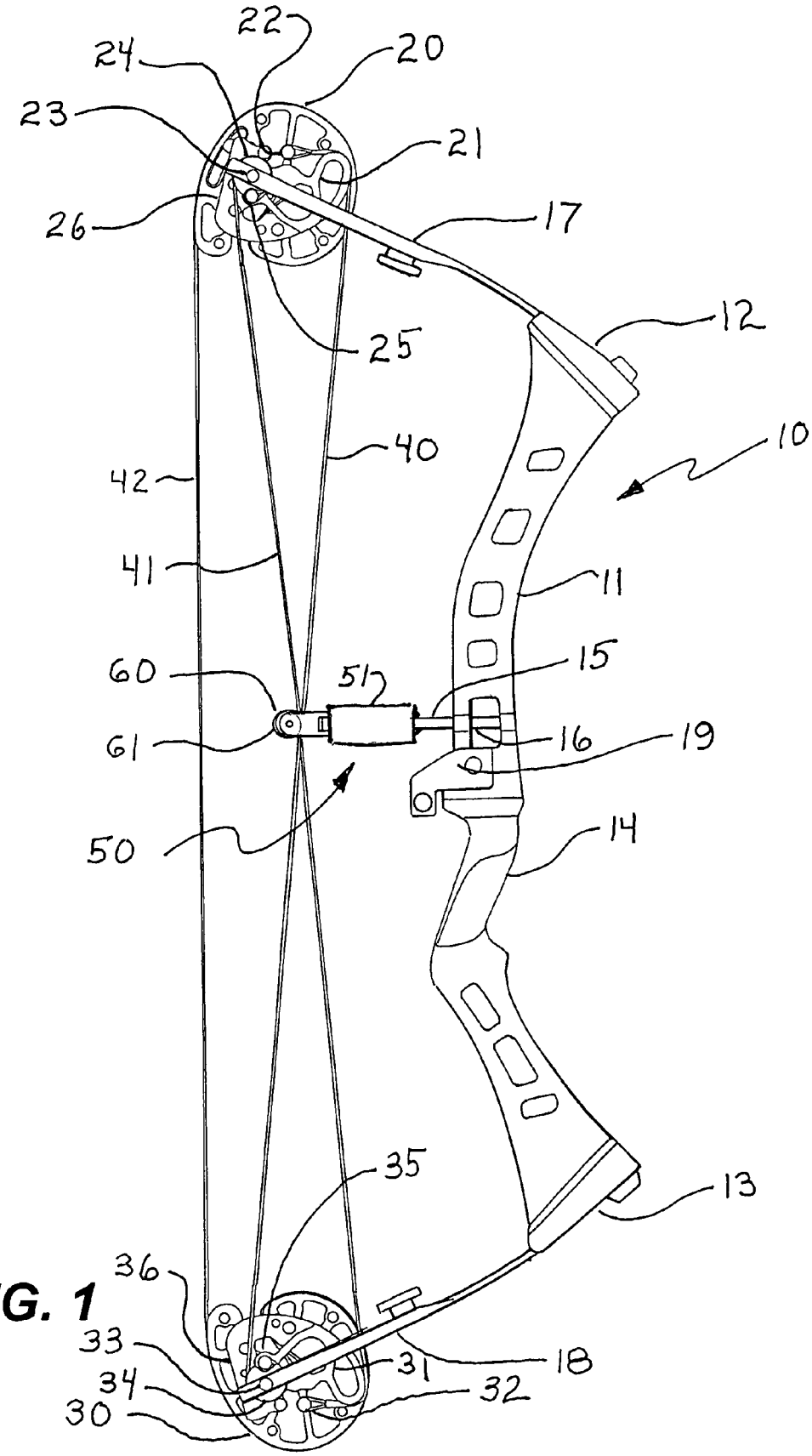
FIG. 1 sets forth a side elevation view of an archery bow having an adjustable cable guide constructed in accordance with the present invention in the relaxed position of the bow.

FIG. 1 sets forth a side elevation view of an archery bow generally referenced by numeral 10 supporting an adjustable cable guide fabricated in accordance with the present invention and generally referenced by numeral 50. FIG. 1 shows archery bow 10 in its relaxed or undrawn position prior to the user gripping the bow with one hand and drawing the bowstring rearwardly to draw and arrow for launch.

More specifically, archery bow 10 includes a riser 11 fabricated of a rigid material such as high strength aluminum or the like. Riser 11 supports a pair of limb sockets 12 and 13 on either end thereof. Riser 11 further includes a hand grip 14 configured in accordance with conventional fabrication techniques. An arrow rest assembly 19 fabricated in accordance with conventional fabrication techniques is supported upon riser 11 above hand grip 14. In accordance with the present invention, a guide bar 15 is secured to riser 11 by a guide attachment 16 fabricated in accordance with conventional fabrication techniques. In further accordance with the present invention, an adjustable cable guide 50 constructed in the manner set forth below is supported upon guide bar 15 by a housing bracket 51. As is also described below, adjustable cable guide 50 further supports a pair of pulleys 60 and 61. The fabrication of adjustable cable guide 50 is set forth below in FIG. 7 in greater detail. Suffice it to note here that cable guide 50 supports pulleys 60 and 61 in a position which may be adjusted.

Bow 10 further includes a pair of flexible limbs 17 and 18 joined to and extending from limb sockets 12 and 13 respectively. Limb 17 supports an axle 23 upon which a pulley 24 is rotatably supported. Axle 23 further defines a compound cam formed by cams 20 and 21 which are joined together to be jointly rotatable about axle 23. Similarly, limb 18 supports an axle 33 which in turn rotatably supports a pulley 34. By further similarity, axle 34 also supports a compound cam formed by cams 30 and 31 which are joined together to be jointly rotatable about axle 33. A cable 40 defines a looped end which is secured to a cable attachment 22 formed on cable 20. Cable 40 extends around cable 21 and downwardly through cable guide 50. The remaining end of cable 40 is wound over pulley 34 and is secured to an attachment 35 formed upon cam 31. A second cable 41 is secured to an attachment 32 formed on cam 30 and is drawn around cam 31. Cable 31 passes upwardly through cable guide 50 and around pulley 24 and is secured to attachment 25 formed on cam 21. A bowstring 42 comprises a cable portion having one end attached to cam 21 at an attachment not shown. Bowstring 42 passes around cam 20 and downwardly to cam 30. Bowstring 42 further extends around cam 30 and attaches to cam 31 at an attachment (not shown).

In the position shown in FIG. 1, bowstring 42 is not drawn and thus bow 10 is in a position often described as "relaxed". Adjustable cable guide 50 is positioned in an offset position relative to the plane of movement of bowstring 42. This avoids interference between the movement of bowstring 42 and the arrow normally positioned thereon with cables 40 and 41.

Figure 2:
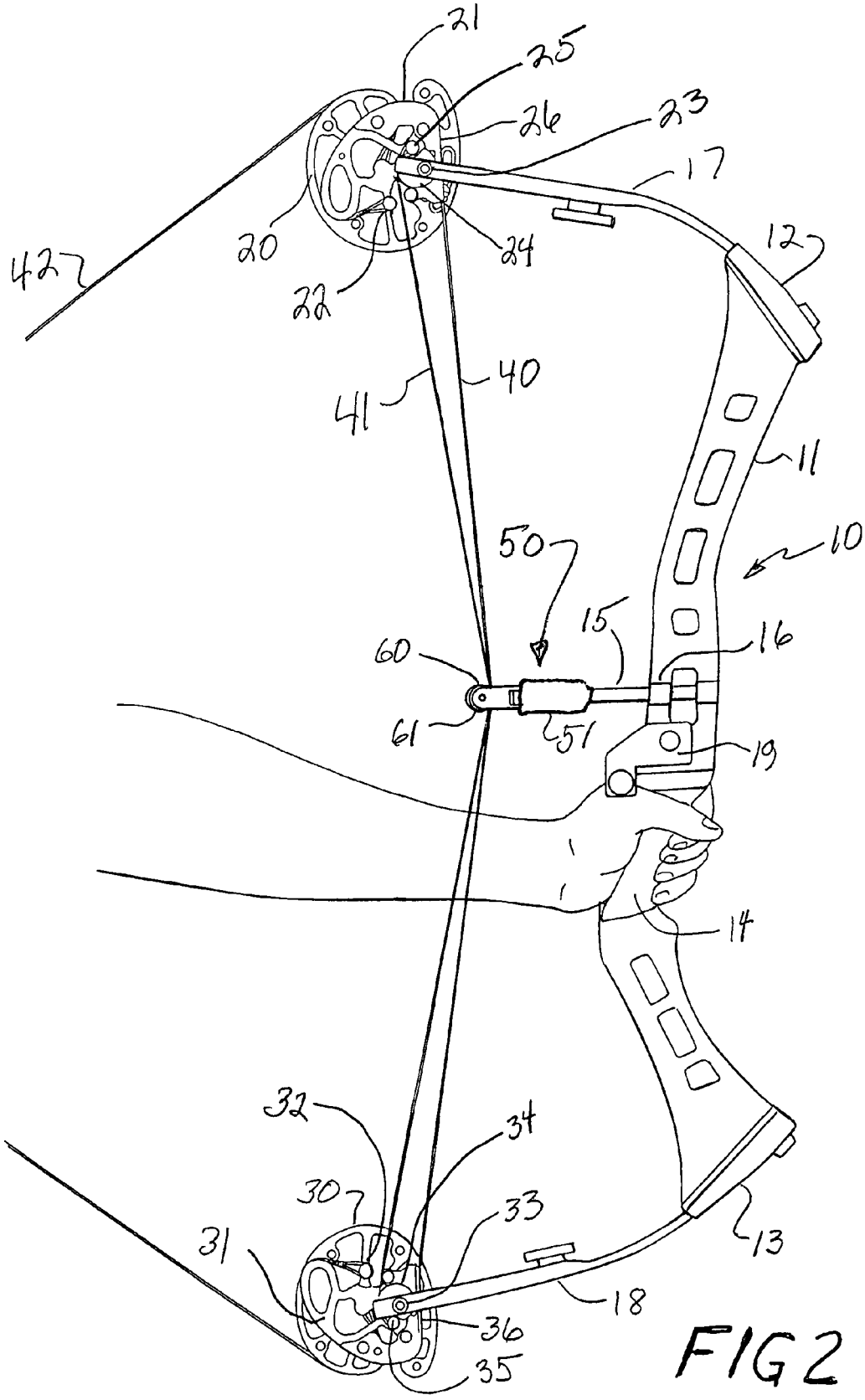
FIG. 2 sets forth the archery bow and adjustable cable guide of FIG. 1 in the drawn position.

FIG. 2 sets forth a side elevation view of archery bow 10 in a drawn position in which the bowstring has been pulled to its full rearward extension as the user grips riser 11.

More specifically, archery bow 10 includes a riser 11 fabricated of a rigid material such as high strength aluminum or the like. Riser 11 supports a pair of limb sockets 12 and 13 on either end thereof. Riser 11 further includes a hand grip 14 configured in accordance with conventional fabrication techniques. An arrow rest assembly 19 fabricated in accordance with conventional fabrication techniques is supported upon riser 11 above hand grip 14. In accordance with the present invention, a guide bar 15 is secured to riser 11 by a guide attachment 16 fabricated in accordance with conventional fabrication techniques. In further accordance with the present invention, an adjustable cable guide 50 constructed in the manner set forth below is supported upon guide bar 15 by a housing bracket 51. As is also described below, adjustable cable guide 50 further supports a pair of pulleys 60 and 61. The fabrication of adjustable cable guide 50 is set forth below in FIG. 7 in greater detail. Suffice it to note here that cable guide 50 supports pulleys 60 and 61 in a position which may be adjusted.

Bow 10 further includes a pair of flexible limbs 17 and 18 joined to and extending from limb sockets 12 and 13 respectively. Limb 17 supports an axle 23 upon which a pulley 24 is rotatably supported. Axle 23 further defines a compound cam formed by cams 20 and 21 which are joined together to be jointly rotatable about axle 23. Similarly, limb 18 supports an axle 33 which in turn rotatably supports a pulley 34. By further similarity, axle 34 also supports a compound cam formed by cams 30 and 31 which are joined together to be jointly rotatable about axle 33. A cable 40 defines a looped end which is secured to a cable attachment 22 formed on cable 20. Cable 40 extends around cable 21 and downwardly through cable guide 50. The remaining end of cable 40 is wound over pulley 34 and is secured to an attachment 35 formed upon cam 31. A second cable 41 is secured to an attachment 32 formed on cam 30 and is drawn around cam 31. Cable 31 passes upwardly through cable guide 50 and around pulley 24 and is secured to attachment 25 formed on cam 21. A bowstring 42 comprises a cable portion having one end attached to cam 21 at an attachment not shown. Bowstring 42 passes around cam 20 and downwardly to cam 30. Bowstring 42 further extends around cam 30 and attaches to cam 31 at an attachment (not shown).

With concurrent reference to FIGS. 1 and 2, it will be noted that cam 21 defines a timing index portion 26 while cam 31 defines a timing index portion 36. Also with reference to FIGS. 1 and 2, it will be noted that cams 20, 21, 30 and 31 are rotated about axles 23 and 33 as bowstring 42 is drawn to the position shown in FIG. 2. It will also be noted by comparing the positions of limbs 17 and 18 in FIGS. 1 and 2 that drawing bowstring 42 bends limbs 17 and 18 inwardly as the bowstring is drawn and cams 20, 21, 30 and 31 are rotated. The inward flexing of limbs 17 and 18 stores energy within the bow which is used to launch an arrow once the arrow (not shown) and bowstring are released.

Returning to FIG. 2, it will be noted that in the drawn position shown in FIG. 2, cable 40 is wound upon cam 21 and extends upon timing index 26. Similarly, cable 41 is wound upon cam 31 and extends upon timing index 36. The position of cables 40 and 41 upon timing indexes 26 and 36 in the drawn position is utilized in the above-described cam timing process. In accordance with an important aspect of the present invention, the timing of cams 20, 21, 30 and 31 may be adjusted to obtain the proper alignment between cables 40 and 41 with timing indexes 26 and 36 respectively by employing the individual adjustment of pulleys 60 and 61 within adjustable cable guide 50. The details of cable adjustment are set forth below in greater detail. Suffice it to note here that adjustment is obtained by moving the relative positions of pulleys 60 and 61 upon cables 40 and 41 respectively.

In accordance with an important aspect of the present invention, the adjustment of cam timing may be carried forward utilizing the independent adjustment of pulleys 60 and 61 within adjustable cable guide 50. Of further importance with respect of the present invention, this adjustment of cable guide 50 may be carried forward without resort to a fixture or any other apparatus.

Figure 4:
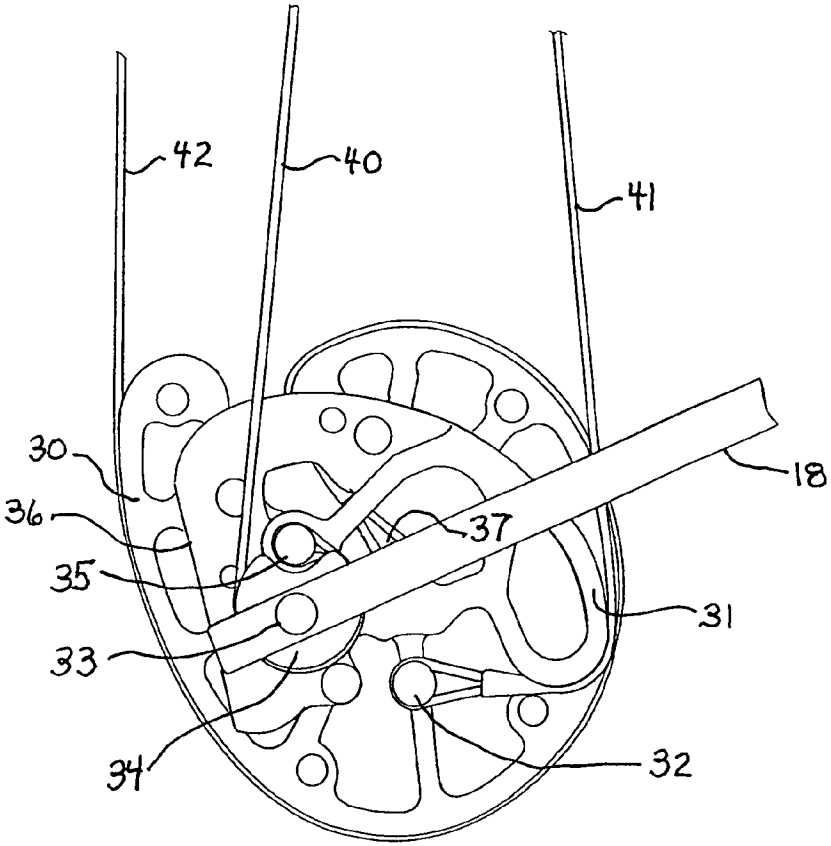
FIG. 4 sets forth an enlarged view of the bottom cam portion of the bow shown in FIG. 1 in its relaxed position.
Figure 3:
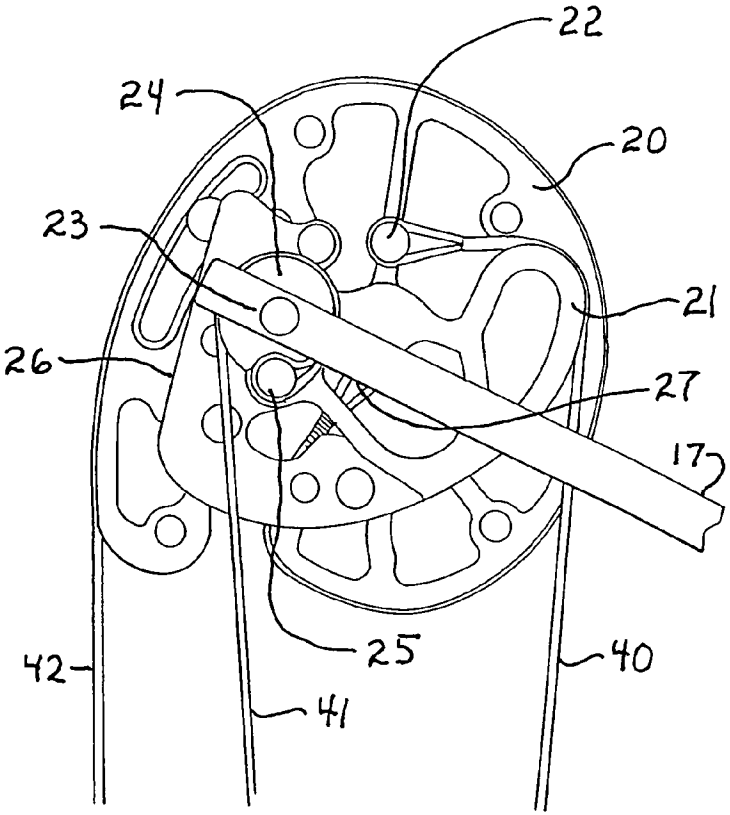
FIG. 3 sets forth an enlarged view of the upper cam and cable portion of the bow shown in FIG. 1 in its relaxed position.
Figure 6:
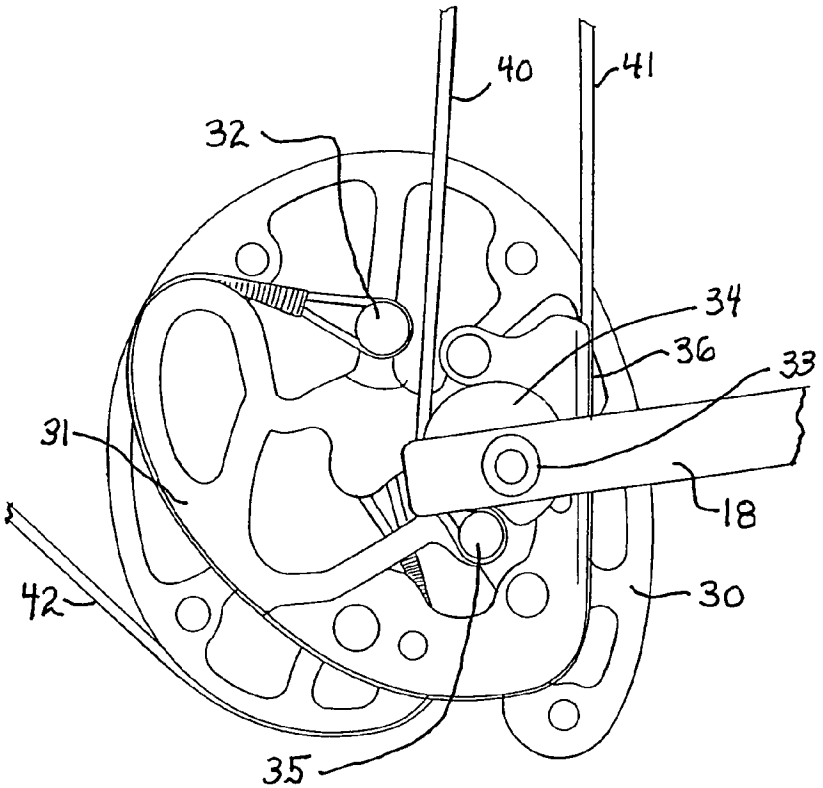
FIG. 6 sets forth an enlarged view of the cam and cable portion of the archery bow shown in FIG. 2 in its drawn position.
Figure 5:
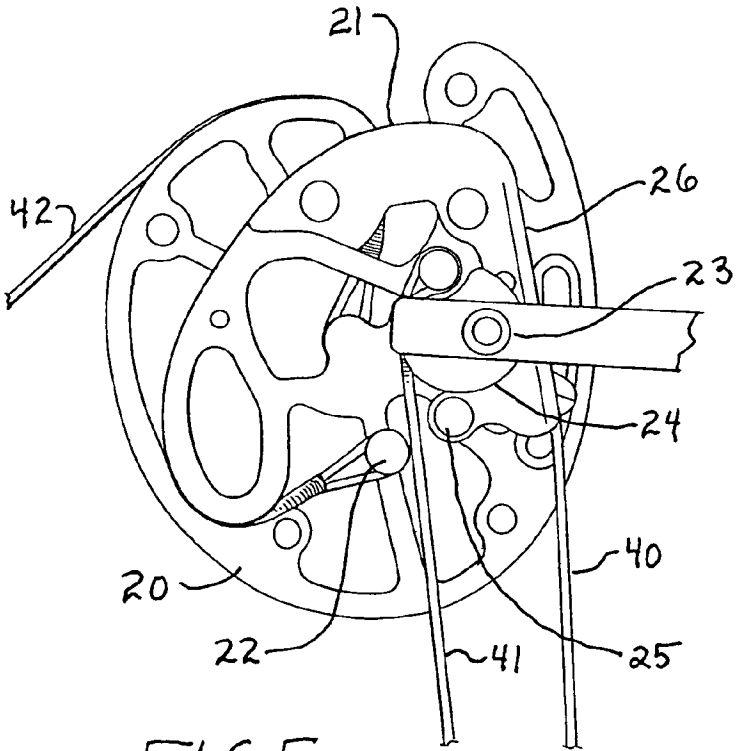
FIG. 5 sets forth an enlarged view of the upper cam of the bow shown in FIG. 2 in its drawn position.

By way of overview, FIGS. 3, 4, 5 and 6 set forth enlarged views of the cam operation and timing position of archery bow 10 in the relaxed and drawn positions. Thus, FIG. 3 shows cams 20 and 21 in the relaxed position, while FIG. 4 shows cams 30 and 31 also in the relaxed position. Further, FIG. 5 shows cams 20 and 21 in the drawn position while FIG. 6 shows cams 30 and 31 also in the drawn positions.

With reference to FIG. 3, cams 20 and 21 are shown in the relaxed position. More specifically, limb 17 supports an axle 23 upon which a pair of mutually joined cams 20 and 21 are rotatably supported. A pulley 24 is also rotatably supported upon axle 23. Cam 20 includes an attachment 22 which receives one end of cable 40. Cable 40 extends about cam 21 and downwardly as described above. Cable 41 is wound about pulley 24 and secured to cam 21 by an attachment 25. The remainder of cable 41 extends downwardly as described above. A bowstring 42 is wound about cam 20 and is secured to the combination of cams 20 and 22 by an attachment 27 (seen behind limb 17).

Once again, it will be noted by examination of FIG. 3 that in the relaxed position shown in FIG. 3, the rotational position of cam 21 separates timing index 26 from cable 40.

FIG. 4 sets forth an enlarged view of cams 30 and 31 in the relaxed position of archery bow 10. More specifically, limb 18 supports an axle 33 about which the combination of cams 30 and 31 is rotatable. Axle 33 also supports a pulley 34. In the relaxed position shown, a cable 41 is joined to cam 30 at an attachment 32. Cable 41 is wound about cam 31 and extends upwardly through cable guide 50 (shown in FIG. 1). Cable 40 is secured to an attachment 35 and is wound about pulley 34. Cable 40 also extends upwardly through cable guide 50 (seen in FIG. 1). A bowstring 42 extends downwardly about cam 30 and is joined to cam 30 at an attachment 37 (seen behind limb 18). As is mentioned above, cam 31 defines a timing index surface 36.

In the relaxed position shown in FIG. 4, it will be noted that cam 31 assumes a rotational position in which timing index 36 is substantially removed from cable 41.

FIG. 5 sets forth an enlarged view of cams 20 and 21 in their relative positions when bowstring 42 is drawn. More specifically, limb 17 supports an axle 23 upon which a pair of mutually joined cams 20 and 21 are rotatably supported. A pulley 24 is also rotatably supported upon axle 23. Cam 20 includes an attachment 22 which receives one end of cable 40. Cable 40 extends about cam 21 and downwardly as described above. Cable 41 is wound about pulley 24 and secured to cam 21 by an attachment 25. The remainder of cable 41 extends downwardly as described above. A bowstring 42 is wound about cam 20 and is secured to the combination of cams 20 and 22 by an attachment 27 (seen behind limb 17).

Of importance to note in FIG. 5 is the alignment of timing index 26 upon cable 40. This alignment is the reference point for timing the cams of the archery bow. Thus, in accordance with the cable adjustment set forth below in greater detail, the user utilizes adjustable cable guide 50 (seen in FIG. 1) to set the length and position of cable 40 to obtain the referenced position shown in FIG. 5.

FIG. 6 sets forth an enlarged view of cams 30 and 31 in the position corresponding to the drawn configuration of archery bow 10. More specifically, limb 18 supports an axle 33 about which the combination of cams 30 and 31 is rotatable. Axle 33 also supports a pulley 34. In the relaxed position shown, a cable 41 is joined to cam 30 at an attachment 32. Cable 41 is wound about cam 31 and extends upwardly through cable guide 50 (shown in FIG. 1). Cable 40 is secured to an attachment 35 and is wound about pulley 34. Cable 40 also extends upwardly through cable guide 50 (seen in FIG. 1). A bowstring 42 extends downwardly about cam 30 and is joined to cam 30 at an attachment 37 (seen behind limb 18). As is mentioned above, cam 31 defines a timing index surface 36.

Of importance to note in FIG. 6 is the position of cable 41 upon timing index 36. Once again, this position is the referenced used in the timing of cams for the archery bow. The timing of cams 30 and 31 is adjusted using adjustable cable guide 50 (seen in FIG. 1) as described below in greater detail.

FIG. 7 sets forth a top view of adjustable cable guide 50 secured to an archery bow in the manner shown in FIGS. 1 and 2. Thus, cable guide 50 is received upon an supported by a guide bar 15 which, as is set forth above in FIGS. 1 and 2, is supported by riser 11. Adjustable cable guide 50 includes a supporting bracket 51 which is secured in position upon guide bar 15 using a set screw 52. Adjustable cable guide 50 is secured to bracket 51 by a plurality of threaded attachments 75, 76, 85 and 86.

More specifically, adjustable cable guide 50 includes a pair of mirror image segments 70 and 80 which are positioned in approximate alignment. Segment 70 rotatably supports a pulley 60 through which a cable is threaded. Segment 70 further includes a movable slide 71 which is movable with respect to the remainder of segment 70. The position of slide 71 with respect to segment 70 is adjusted in the manner described below by rotating an adjustment screw 72. Suffice it to note here that adjustment screw 72 threadably engages segment 70 and is joined to slide 71 such that rotation of adjustment screw 72 moves segment 70 with respect to slide 71. Similarly, segment 80 supports a pulley 61 through which a cable is threaded. Segment 80 includes a movable slide 81 which is slidably movable with respect to the remainder of segment 80. The position of slide 81 with respect to segment 80 is controlled by an adjustment screw 82. Once again, screw 82 threadably engages segment 80 and is rotatable with respect to slide 81 such that rotation of screw 82 moves segment 80. Segment 70 includes a set screw 73 which secures the desired position of slide 71 while segment 80 supports a set screw 83 which secures the position of slide 81 upon segment 80. It will be apparent to those skilled in the art that pulleys 60 and 61 provide the preferred bearing structure for engaging cables 40 and 41 due to their low friction rolling engagement. It will be equally apparent, however, that other engagement bearings such as curved fixed surfaces or grooved bearings may be used in place of pulleys 60 and 61 for cable engagement without departing from the spirit and scope of the present invention.

It will be noted that the attachment of slide 71 to bracket 51 using screws 75 and 76 provides that rotation of adjustment screw 72 in either direction moves segment 70 and thereby pulley 60 in the desired direction as indicated by arrows 74. Similarly, the attachment of slide 81 to bracket 51 by attachment screws 85 and 86 ensures that rotation of adjustment screw 82 moves segment 80 and thereby pulley 61 with respect to slide 81 in the directions indicated by arrows 84.

In accordance with the present invention, the adjustment of screws 72 and 82 is utilized in moving pulleys 60 and 61 and thereby adding to or subtracting from the effective length of cables 40 and 41 within archery bow 10 (seen in FIG. 1). The adjustment of cables 40 and 41 is carried forward with an eye toward the positions of the timing indexes described above in FIGS. 3, 4, 5 and 6.

FIG. 8 sets forth a perspective view of one segment of adjustable cable guide 50 which is suitable for use in adjusting a single cable position should the need arise. Thus, FIG. 8 shows segment 70 of adjustable cable guide 50 in perspective view. Thus, as described above, segment 70 supports a rotatable pulley 60 and further supports a slide 71. Slide 71 further defines a pair of threaded apertures 90 and 91 which are utilized in securing slide 71 to a reference surface such as the riser of a bow or the like. An adjustment screw 72 is coupled to slide 71 and threadably engages segment 70 in the manner set forth below in FIG. 10. Suffice it to note here that rotation of adjustment screw 72 moves the position of slide 71 with respect to segment 70. A set screw 73 is operative to secure the position of slide 71 upon segment 70.

FIG. 9 sets forth a side elevation view of segment 80 used in a single cable adjustment manner. Thus, as described above, segment 80 supports a pulley 61 and a movable slide 81. Slide 81 is operatively positioned upon segment 80 by a rotatable adjustment screw 82 in the manner shown below in FIG. 10. A set screw 83 is utilized in securing the position of slide 81 with respect to segment 80. A pair of threaded apertures 92 and 93 are formed on slide 81 and utilized in the above-described manner for securing segment 80 to a supporting surface.

Figure 10:
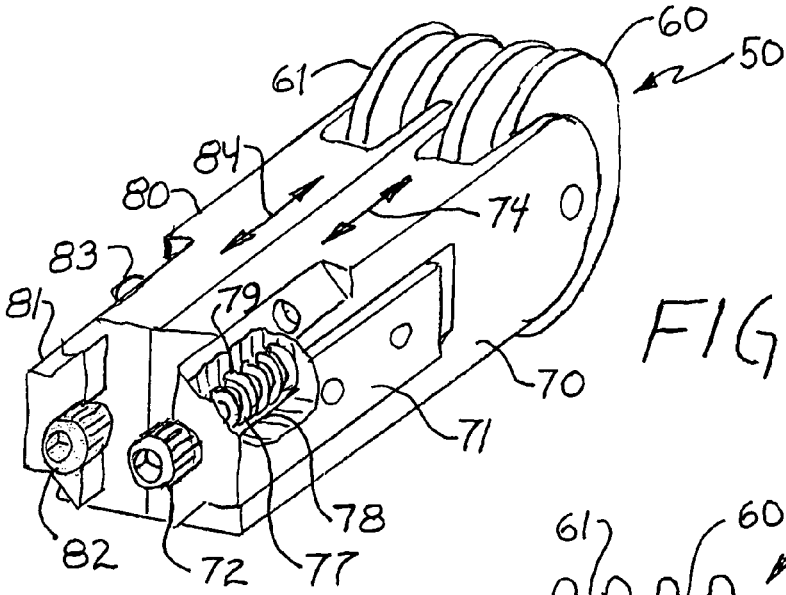
FIG. 10 sets forth a partially sectioned section view of the present invention adjustable cable guide.

FIG. 10 sets forth a partially sectioned perspective view of adjustable cable guide 50 showing the threaded coupling between the adjustment screw and the movable slide. It will be apparent to those skilled in the art that the mirror image structure is employed on the opposite side of adjustable cable guide 50.

More specifically, adjustable cable guide 50 includes a pair of mirror image segments 70 and 80 which are positioned in approximate alignment. Segment 70 rotatably supports a pulley 60 through which a cable is threaded. Segment 70 further includes a movable slide 71 which is movable with respect to the remainder of segment 70. The position of slide 71 with respect to segment 70 is adjusted in the manner described below by rotating an adjustment screw 72. Suffice it to note here that adjustment screw 72 threadably engages segment 70 and is joined to slide 71 such that rotation of adjustment screw 72 moves segment 70 with respect to slide 71. Similarly, segment 80 supports a pulley 61 through which a cable is threaded. Segment 70 includes a movable slide 81 which is slidably movable with respect to the remainder of segment 80. The position of slide 81 with respect to segment 80 is controlled by an adjustment screw 82. Once again, screw 82 threadably engages segment 80 and is rotatable with respect to slide 81 such that rotation of screw 82 moves segment 80. Segment 70 includes a set screw 73 which secures the desired position of slide 71 while segment 80 supports a set screw 83 which secures the position of slide 81 upon segment 80.

In the preferred fabrication of present invention, the relative position of slide 71 with respect to segment 70 is adjusted by rotating adjustment screw 72. The section view of FIG. 10 shows that adjustment screw 70 defines a plurality of helical threads or preferably a helical worm gear. The section view of FIG. 10 also shows a clearance channel 78 which is formed in slide 71 as well as a gear rack or complimentary thread portion 79 formed in segment 70. Thus, adjustment screw 72 is captivated within slide 71 but is freely rotatable due to the clearance of channel 78. Conversely, the presence of complimentary thread or gear rack 79 which engages helical threads 77 or screw 72 provides for movement between adjustment screw 72 and slide 71 relative to segment 70 as adjustment screw 72 is rotated in either direction. It will be apparent to those skilled in the art that the operative functions of clearance passage and engaging threads utilized for slide 71 and segment 70 may be switched without departing from the spirit and scope of the present invention. It will be further apparent to those skilled in the art that different mechanisms may be utilized to move slide 71 relative to segment 70 without departing from the spirit and scope of the present invention. In addition, while the operative mechanism utilized in segment 80 relative to slide 81 and adjustment screw 82 is not shown, it will be apparent to those skilled in the art that the same or similar mechanism is utilized. Thus, rotation of adjustment screws 72 and 82 moves segments 70 and 80 in the manner indicated by arrows 74 and 84.

Figure 11:
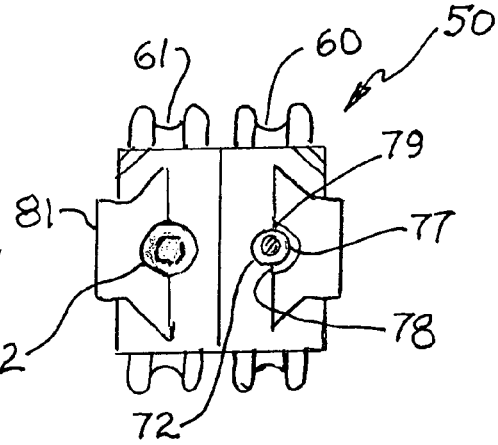
FIG. 11 shows a partially sectioned end view of the present invention adjustable cable guide.

FIG. 11 sets forth a partially sectioned end view of adjustable cable guide 50 having a section of adjustment screw 72 which further shows the engagement of screw 72 within segment 70. As described above, adjustable cable guide 50 includes segments 70 and 80 supporting pulleys 60 and 61 respectively. Segment 70 supports a movable slide 71 while segment 80 supports a movable slide 81. The position of slide 71 is adjusted by rotating adjustment screw 72 while the position of slide 81 is adjusted by rotating adjustment screw 82. As described above, slide 71 defines a clearance passage 78 which does not engage helical thread 77 of adjustment screw 72. In the section view of FIG. 11, the head portion of adjustment screw 72 is not viewed due to the section view. FIG. 11 also shows engaging thread 79 formed in segment 70 which engages helical threads 77 of adjustment screw 72. Thus, as adjustment screw 72 is rotated, helical threads 77 engage complimentary threads 79 to cause movement of adjustment screw 72 and thereby slide 71 with respect to segment 70. The attachment between adjustment screw 72 and slide 71 utilizes a conventional rotational attachment (not shown).

Figure 12:
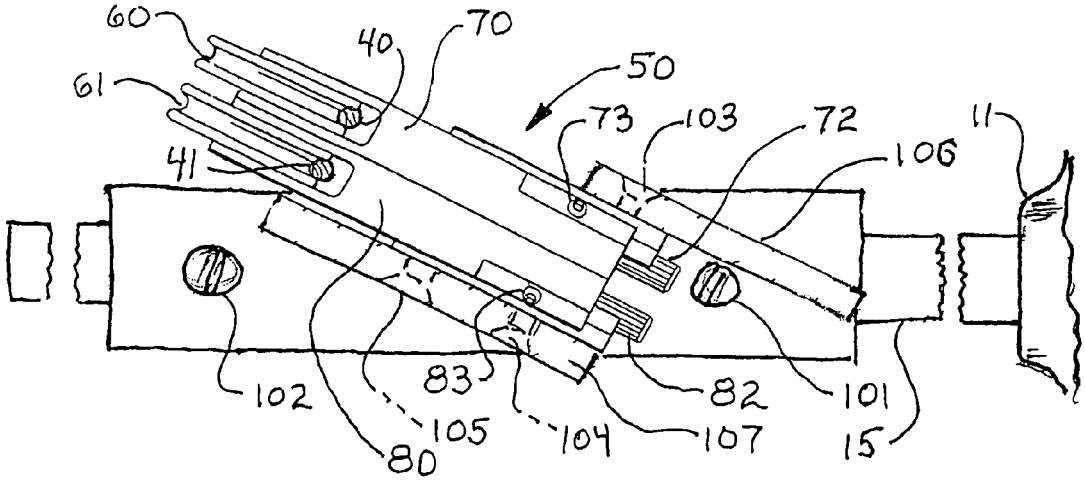
FIG. 12 sets forth a top view of an alternate embodiment of the present invention adjustable cable guide.

FIG. 12 sets forth a top view of an alternate embodiment of the present invention adjustable cable guide. Comparison of FIGS. 7 and 12 reveals that adjustable cable guide 50 is utilized in both embodiments. The difference between the embodiments shown in FIGS. 7 and 12 is found in the manner by which the adjustable cable guide is supported upon guide bar 15. Thus, it will be recalled that guide bar 15 extends rearwardly from riser 11 (seen in FIG. 1). A housing 100 defines a center bore which receives guide bar 15. Housing 100 is movable upon guide bar 15 and is secured at the desired position by a pair of set screws 101 and 102. Housing 100 further supports a pair of angled flanges 106 and 107 which are spaced apart upon housing 100 and which are angled inwardly. In accordance with the present invention, adjustable cable guide 50 is positioned between flanges 106 and 107. The fabrication of adjustable cable guide 50 is described above in greater detail.

More specifically, adjustable cable guide 50 includes a pair of mirror image segments 70 and 80 which are positioned in approximate alignment. Segment 70 rotatably supports a pulley 60 through which a cable is threaded. Segment 70 further includes a movable slide 71 which is movable with respect to the remainder of segment 70. The position of slide 71 with respect to segment 70 is adjusted in the manner described below by rotating an adjustment screw 72. Suffice it to note here that adjustment screw 72 threadably engages segment 70 and is joined to slide 71 such that rotation of adjustment screw 72 moves segment 70 with respect to slide 71. Similarly, segment 80 supports a pulley 61 through which a cable is threaded. Segment 70 includes a movable slide 81 which is slidably movable with respect to the remainder of segment 80. The position of slide 81 with respect to segment 80 is controlled by an adjustment screw 82. Once again, screw 82 threadably engages segment 80 and is rotatable with respect to slide 81 such that rotation of screw 82 moves segment 80. Segment 70 includes a set screw 73 which secures the desired position of slide 71 while segment 80 supports a set screw 83 which secures the position of slide 81 upon segment 80.

A plurality of threaded fasteners 103, 104 and 105 secure adjustable cable guide 50 between flanges 106 and 107. The operation of adjustable cable guide 50 is carried forward as described above with the utilization of adjustment screws 72 and 82 in establishing the desired positions of pulleys 60 and 61. The position of pulleys 60 and 61 provides greater or lesser tension upon cables 40 and 41 adjusting the effective length of cables 40 and 41 and thereby achieving the timing of cams as described above. Once the desired positions of pulleys 60 and 61 have been obtained, set screws 73 and 83 are utilized to secure the positions of segments 70 and 80 and thereby the positions of pulleys 60 and 61.

Figure 13:
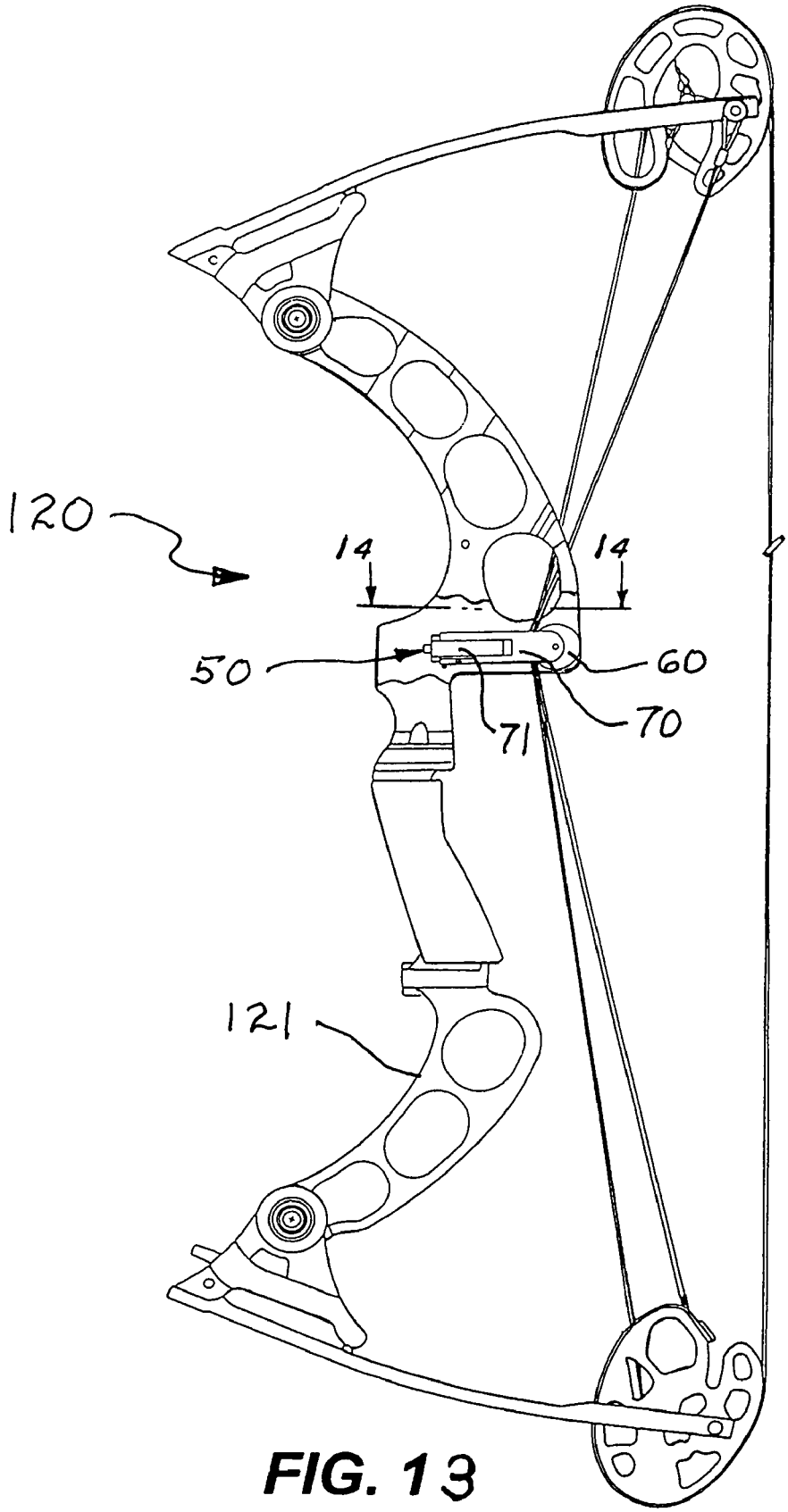
FIG. 13 sets forth a partially sectioned side elevation view of an archery bow having an alternate embodiment of the present invention adjustable cable guide.

FIG. 13 sets forth a partially section side elevation view of an archery bow 120 which supports adjustable cable guide 50 in a internal support channel fabricated within the bow riser. Thus, bow 120 includes a riser 121 defining an interior channel 122 (seen in FIG. 14). Within which adjustable cable guide 50 is supported. The advantage of the embodiment of the present invention shown in FIG. 13 is the substantial support which adjustable cable guide 50 receives within the rigid structure of riser 121.

FIG. 14 set forth a partial section view of the embodiment of FIG. 13 taken along section lines 14-14 therein. As can be seen in FIG. 14, adjustable cable guide 50 is secured by a plurality of attachment screws 125 through 128. The structure of adjustable cable guide 50 is described above in greater detail. Thus, the function of adjustable cable guide 50 is carried forward to adjust the positions and tensions of cables 40 and 41 in the manner described above.

More specifically, adjustable cable guide 50 includes a pair of mirror image segments 70 and 80 which are positioned in approximate alignment. Segment 70 rotatably supports a pulley 60 through which a cable is threaded. Segment 70 further includes a movable slide 71 which is movable with respect to the remainder of segment 70. The position of slide 71 with respect to segment 70 is adjusted in the manner described below by rotating an adjustment screw 72. Suffice it to note here that adjustment screw 72 threadably engages segment 70 and is joined to slide 71 such that rotation of adjustment screw 72 moves segment 70 with respect to slide 71. Similarly, segment 80 supports a pulley 61 through which a cable is threaded. Segment 70 includes a movable slide 81 which is slidably movable with respect to the remainder of segment 80. The position of slide 81 with respect to segment 80 is controlled by an adjustment screw 82. Once again, screw 82 threadably engages segment 80 and is rotatable with respect to slide 81 such that rotation of screw 82 moves segment 80. Segment 70 includes a set screw 73 which secures the desired position of slide 71 while segment 80 supports a set screw 83 which secures the position of slide 81 upon segment 80.

Thus, with adjustable cable guide 50 secured within channel 122 formed in riser 121 by attachment screws 125 through 128, the positions of pulleys 60 and 61 are adjusted by rotating adjustment screws 72 and 82 respectively.

What has been shown is an adjustable cable guide for archery bow which utilizes independent adjustment of each cable within the archery bow to provide timing of the cams without resort to a fixture or special jig. The adjustment is carried forward by simple rotation of adjustment screws and is maintained by tightening of simple set screws to secure the adjustment once obtained. The entire adjustment process is economical and time saving and avoids the need for expensive and cumbersome apparatus. The adjustment may be carried forward by simply drawing the bow and thereafter noting the positions of timing indexes of the cams upon the cables and making simple adjustment.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An adjustable cable guide for use in combination with an archery bow, wherein said archery bow includes two bow cables, each defining an effective length, said adjustable cable guide comprising:

at least one engagement for engaging at least one said bow cable;

at least one continuous position adjuster supporting said at least one engagement in a continuously adjustable position; and support means for supporting said at least one adjuster upon a bow such that said at least one engagement engages at least one said bow cable;

and wherein said at least one continuous position adjuster continuously adjusts the effective length of one of said bow cables relative to the other of said bow cables.

2. The adjustable cable guide set forth in claim 1 wherein said support means is constructed to attach to a bow riser and wherein said at least one engagement includes at least one pulley rotatably supported upon said at least one adjuster.

3. The adjustable cable guide set forth in claim 2 wherein said at least one adjuster includes a cable guide segment supporting said at least one pulley and a slide supported on said support means and a movement member coupled between said cable guide segment and said slide for changing the position therebetween.

4. The adjustable cable guide set forth in claim 3 wherein said movement member includes a threaded element engaging either of said slide or said cable guide segment to move the engagement one thereof relative to the other when said threaded element is rotated.

5. The adjustable cable guide set forth in claim 4 wherein said cable guide segment includes a set screw for engaging said slide to fix its position.

6. The adjustable cable guide set forth in claim 5 wherein said support means includes:

a guide bar securable to a bow riser; and a bracket supporting said at least one slide joined to said guide bar.

7. The adjustable cable guide set forth in claim 6 wherein said bracket supports said cable guide segment in general alignment with said guide bar.

8. The adjustable cable guide set forth in claim 6 wherein said bracket supports said cable guide segment at an angle relative to said guide bar.

9. An adjustable cable guide for use in combination with an archery bow, said adjustable cable guide comprising:

a pair of engagements for engaging a pair of bow cables;

a pair of adjusters supporting said pair of engagements in independently adjustable positions; and support means for supporting said pair of adjusters upon a bow such that said pair of engagements engage a pair of bow cables.

10. The adjustable cable guide set forth in claim 9 wherein said support means is constructed to attach to a bow riser and wherein said pair of engagements each include a pulley rotatably supported upon said adjuster.

11. The adjustable cable guide set forth in claim 10 wherein said pair of adjusters each include a cable guide segment supporting one of said pulleys and a slide supported on said support means and a movement member coupled between said cable guide segment and said slide for changing the position therebetween.

12. The adjustable cable guide set forth in claim 11 wherein said movement members each include a threaded element engaging either of said slide or said cable guide segment to move the engagement one thereof relative to the other when said threaded element is rotated.

13. The adjustable cable guide set forth in claim 12 wherein said cable guide segment includes a set screw for engaging said slide to fix its position.

14. The adjustable cable guide set forth in claim 13 wherein said support means includes:

a guide bar securable to a bow riser; and a bracket supporting said a pair of slides joined to said guide bar.

15. The adjustable cable guide set forth in claim 14 wherein said bracket supports said cable guide segment in general alignment with said guide bar.

16. The adjustable cable guide set forth in claim 14 wherein said bracket supports said cable guide segment at an angle relative to said guide bar.

17. For use in combination with an archery bow having a riser, limbs and plurality of pulleys thereon together with a plurality of cables therebetween, an independently adjustable cable guide comprising:

a first guide segment supporting a first rotatable pulley, a first slide moveable upon said first guide segment and a first adjustable coupler coupled between said first guide segment and said first slide to adjust the position therebetween;

a second guide segment supporting a second rotatable pulley, a second slide moveable upon said second guide segment and a second adjustable coupler coupled between said second guide segment and said second slide to adjust the position therebetween; and a guide support on the bow riser for supporting said first and second guide segments such that said first and second pulleys each engage a bow cable, said adjustment of said first and second adjustable couplers providing independent position adjustments of said first and second pulleys against respective bow cables.

18. The independently adjustable cable guide set forth in claim 17 wherein said first and second slides are attached to said guide support and said first and second guide segments and pulleys are independently moveable by adjusting said first and second adjustable couplers.

* * * * *